US005485825A

United States Patent [19]

Shimizu et al.

[11] Patent Number: 5,485,825

[45] Date of Patent: Jan. 23, 1996

[54] INTERNAL COMBUSTION ENGINE IGNITION DEVICE

[75] Inventors: Takeshi Shimizu; Masaaki Taruya; Shigemi Murata; Mitsuru Koiwa; Toshio Maekawa, all of Hyogo, Japan

[73] Assignee: Mitsubishi Denki Kabushiki Kaisha, Tokyo, Japan

[21] Appl. No.: 259,682

[22] Filed: Jun. 13, 1994

[30] Foreign Application Priority Data

Jul. 9, 1993 [JP] Japan ..... 5-170414

[51] Int. Cl.[6] ..... F02P 3/02

[52] U.S. Cl. ..... 123/634; 361/709

[58] Field of Search ..... 123/634, 635, 123/647; 361/709, 710, 711, 704

[56] References Cited

U.S. PATENT DOCUMENTS 4,248,201 2/1981 Tsutsui et al. ..... 123/647
5,172,302 12/1992 Taruya et al. ..... 123/634
5,359,982 11/1994 Taruya ..... 123/634

FOREIGN PATENT DOCUMENTS 5-87034 4/1993 Japan .
5-343246 12/1993 Japan .

*Primary Examiner*—Andrew M. Dolinar
*Attorney, Agent, or Firm*—Richard C. Turner; Steven M. Gruskin; Sughrue, Mion, Zinn, Macpeak & Seas

[57] ABSTRACT

An internal combustion engine ignition device comprises an ignition coil, a preliminary assembly, and a casing for accommodating and covering the ignition coil and the preliminary assembly with resin. The preliminary assembly comprises a heat sink, a control unit, and a cushion cover for covering the heat sink and control unit and having at least one first protrusion. The control unit comprises a control circuit for controlling the flow of primary current in the ignition coil, and at least one first recess for engaging with the first protrusion of the cushion cover.

4 Claims, 3 Drawing Sheets

INTERNAL COMBUSTION ENGINE IGNITION DEVICE

BACKGROUND

This invention relates to an internal combustion engine ignition device having a control unit including a control circuit which is covered with resin by molding and held in a casing in which an ignition coil is set.

FIG. 6 is a broken view showing a conventional internal combustion engine ignition device. In FIG. 6, reference numeral 6 designates an IC package including a power switch made up of a current limit circuit or the like which is covered with resin; 7, a heat sink for effectively radiating heat from the IC package; and 9, a holder holding the IC package 6.

Further in FIG. 6, reference numeral 10 denotes a casing including an accommodating section 11 for accommodating the ignition coil (not shown) and the IC package 6, and a connector section 12; and 13, a guide used to accommodate the IC package 6 in the accommodating section 11.

The conventional internal combustion engine ignition device suffers from the following difficulty: In general, the internal combustion engine ignition device is used in a severe environment in which the temperature changes from high to low, and vice versa, repeatedly. In this case, a thermal stress is set up by the difference in the coefficient of linear expansion between the assembly of the IC package 6 and the heat sink 7, and the casing 10. Therefore, the casing 10 may be cracked by the shearing stress between these parts.

Accordingly, an object of the present invention is to eliminate the above-described difficulty accompanying a conventional internal combustion engine ignition device. More specifically, an object of the present invention is to provide an internal combustion engine ignition device which is high in durability under severe environmental conditions.

A further object of the invention is to provide an internal combustion engine ignition device which is high in assembling efficiency.

SUMMARY

To achieve the above-mentioned objects, one aspect of the present invention provides an internal combustion engine ignition device comprising an ignition coil, a preliminary assembly, and a casing for accommodating and covering the ignition coil and the preliminary assembly with resin by molding. The preliminary assembly comprises a heat sink, a control unit, and a cushion cover for covering the heat sink and control unit. The control unit comprises a control circuit for controlling the flow of primary current in the ignition coil.

Another aspect of the present invention provides the above-mentioned internal combustion engine ignition device wherein the cushion cover has at least one first protrusion, and the control unit further comprises at least one first recess which is engaged with the first protrusion of the cushion cover.

Another aspect of the present invention provides the above-mentioned internal combustion engine ignition device wherein the control unit has at least one second recess, and the heat sink has at least one second protrusion which is engaged with the second recess of the control unit.

Another aspect of the present invention provides an internal combustion engine ignition device wherein a cushion cover includes a wall for preventing components from coming off.

According to the first aspect of the present invention, the preliminary assembly has a cushion cover for covering the heat sink and control unit. Therefore, the thermal stress thus set up is absorbed by the cushion cover, which prevents the elements from damage. Thus, the ignition device can achieve high durability under severe environmental conditions.

According to the second aspect of the present invention, the control unit has the first recess, and the cushion cover has a protrusion which is engaged with the first recess of the control unit. Hence, in setting the preliminary assembly in the accommodating section of the casing, the heat sink, the control unit and the cushion cover will never come off. That is, the ignition device can be assembled with high efficiency.

According to the third aspect, the control unit has the second recess, and the heat sink has a protrusion which is engaged with the second recess of the control unit. Hence, the components can be positioned with ease, and combined positively. Therefore, the preliminary assembly can be formed with high efficiency. In addition, in setting the preliminary assembly in the accommodating section of the casing, the heat sink, the control unit and the cushion cover will never come off. That is, the ignition device of the invention can be assembled with high efficiency.

According to the fourth aspect, the cushion cover includes the wall for preventing components from coming off. Therefore, in setting the preliminary assembly in the accommodating section of the casing, the heat sink, the control unit and the cushion cover will never come off. That is, the ignition device can be assembled with high efficiency.

DETAILED DESCRIPTION OF THE PREFERRED EMBODIMENTS

Preferred embodiments of this invention will be described with reference to the accompanying drawings.

Figure 4:
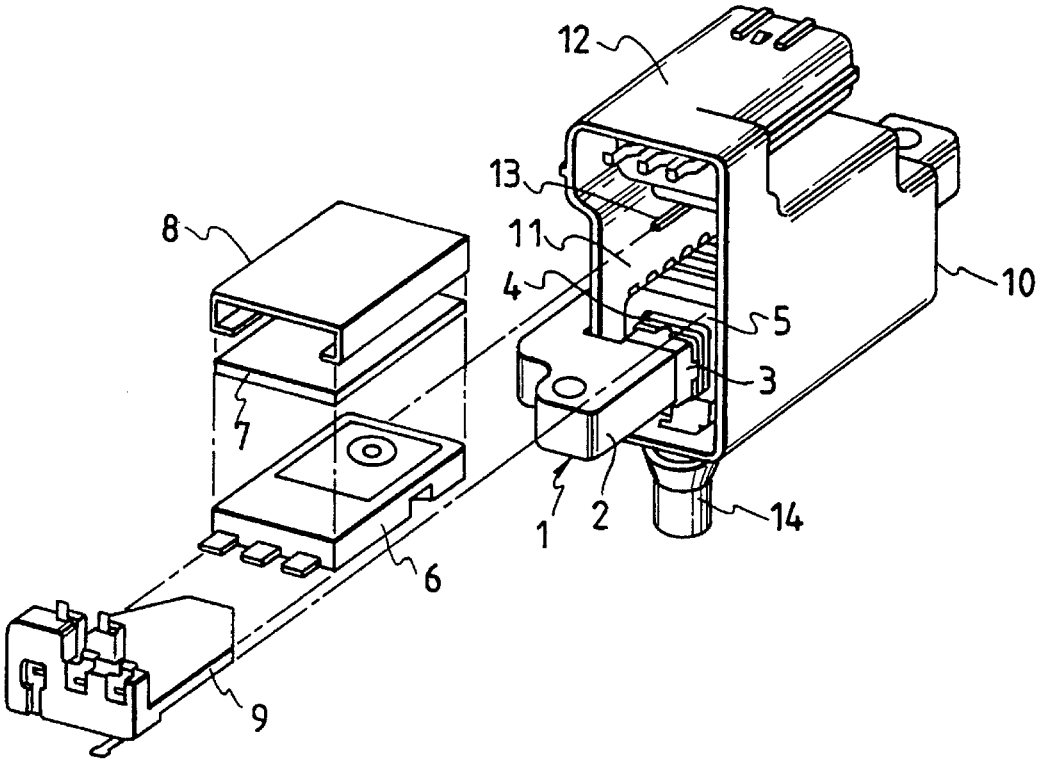
FIG. 4 is a broken perspective view showing an internal combustion engine ignition device according to the first embodiment of the present invention.
Figure 6:
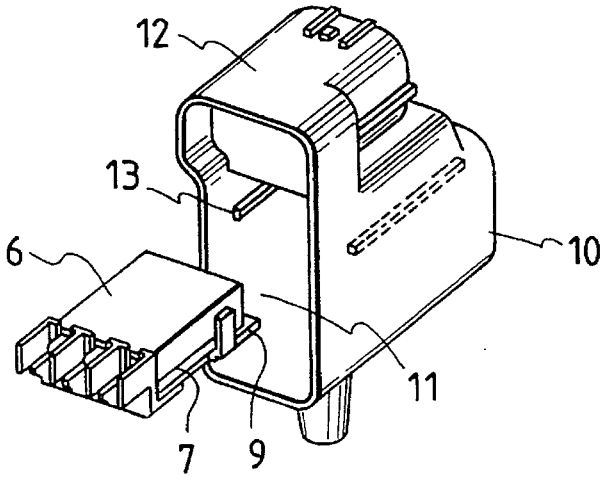
FIG. 6 PRIOR ART
FIG. 6 is a broken perspective view showing a conventional internal combustion engine ignition device.

FIG. 4 is a broken perspective view showing an internal combustion engine ignition device, which constitutes a first embodiment of the invention. In FIG. 4, parts corresponding functionally to those which have been described with reference to FIG. 6 showing the conventional internal combustion engine ignition device are therefore designated by the same reference numerals or characters.

In FIG. 4, reference numeral 1 designates an ignition coil, which comprises a primary coil 4 wound through a bobbin 3 on an iron core 2, and a secondary coil (not shown) wound through a bobbin 5 on the primary coil 4.

The internal combustion engine ignition device according to the present invention thus organized is assembled as follows: First, the bobbin 3, on which the primary coil 4 has been wound, is set in the casing 1. Next, the bobbin 5, on which the secondary coil has been wound in such a manner as to surround the primary coil 4, is set in the casing 1. That is, the ignition coil 1 is set in the accommodating section 11.

The IC package 6, and the heat sink 7 are covered with the cushion cover 8, and the terminals of the IC package 6 are connected to the terminals of the holder 9, to form a preliminary assembly. The preliminary assembly is moved along the guide 13 until it is set in the accommodating section 11, and then the terminals of the ignition coil 1, the holder 9, the connector section 12, and the high voltage terminal 14 are electrically connected. Thereafter, the iron core 2 is set. Under this condition, insulating resin (not shown) is injected into the casing, and solidified, so that the ignition coil 1 and the IC package 6 formed by covering the power switch with resin are fixedly held as one unit in the casing 10.

The above-described internal combustion engine ignition device thus formed operates as follows:

In synchronization with the ignition timing of the o internal combustion engine, the power switch of the IC package 6 is turned off, so that the primary current of the primary coil 4 is cut off, and a high voltage is therefore induced in the secondary coil. The high voltage thus induced is applied through the high voltage terminal 14 to the distributor.

In the internal combustion engine ignition device which is described above, the thermal stress thus set up is absorbed by the cushion cover 8, which prevents the elements from damage. Thus the ignition device is high in durability under severe environmental condition.

Figure 1:
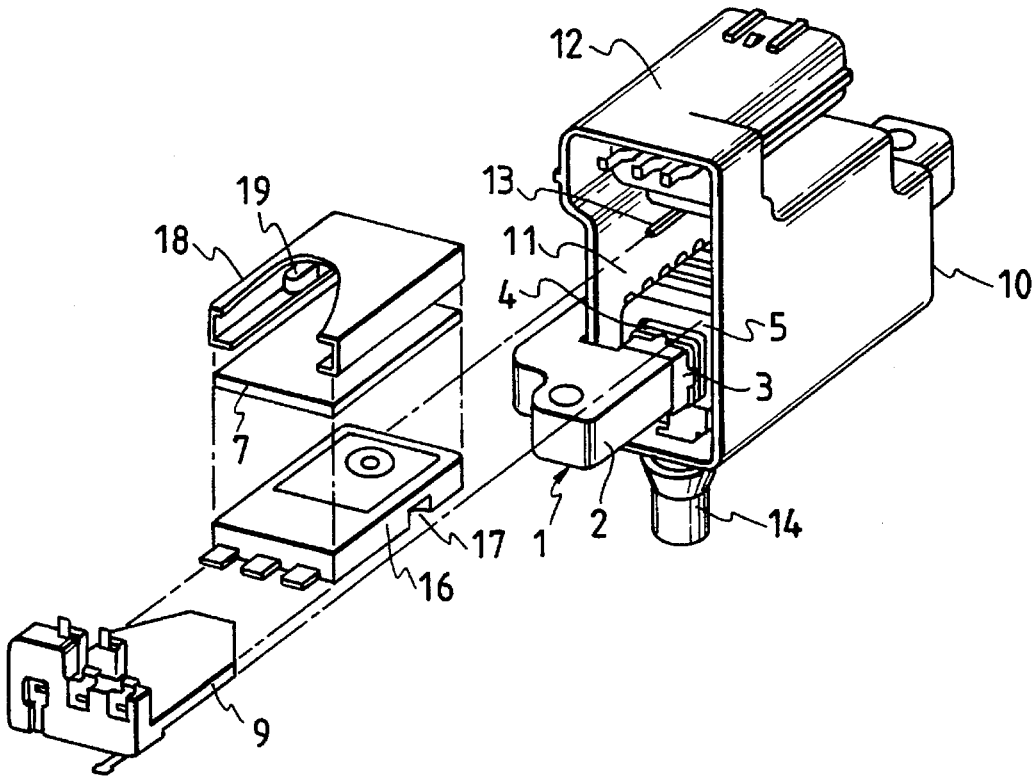
FIG. 1 is a broken perspective view showing an internal combustion engine ignition device according to the second embodiment of the present invention.

FIG. 1 is a broken perspective view showing an internal combustion engine ignition device according to the second embodiment of the present invention. In FIG. 1, parts corresponding functionally to those which have been described with reference to FIG. 4 showing the internal combustion engine ignition device are therefore designated by the same reference numerals or characters.

In FIG. 1, reference numeral 16 designates an IC package as a control unit, comprising a power switch made up of a power transistor current limit circuit or the like which is covered with resin by molding; 17, a recess formed in the IC package 16; 18, a cushion cover surrounding the IC package 16 and the heat sink 7 (the cushion cover shown with parts cut away); and 19, a protrusion which is engaged with the recess 17 of the IC package 16.

The internal combustion engine ignition device according to the second embodiment is assembled as follows:

First, the bobbin 3, on which the primary coil 4 has been wound, is set in the casing 1. And then the bobbin 5, on which the secondary coil has been wound in such a manner as to surround the primary coil 4, is set in the casing; that is, the ignition coil 1 is set in the accommodating section 11.

The IC package 16 and the heat sink 7 are covered with the cushion cover 18 with the protrusion 19 of the cushion cover 18 engaged with the recess 17 of the IC package 16.

The terminals of the IC package 16 are connected to those of the holder 9, to form a preliminary assembly.

The preliminary assembly thus formed is moved along the guide 13 until it is set in the accommodating section 11. Under this condition, the terminals of the ignition coil 1, the holder 9, the connector section 12, and the high voltage terminal 14 are electrically connected, and thereafter the iron core 2 is set. Under this condition, insulating resin (not shown) is injected into the casing, and solidified, so that the ignition coil 1 and the IC package 16 formed by covering the power switch with resin by molding are fixedly held as one unit in the casing 10.

The internal combustion engine ignition device according to the second embodiment of the invention operates in the same way as the first one.

In the above-described second embodiment, the IC package 16 has the recess 17, and the cushion cover 18 has the protrusion which is engaged with the recess 17. Hence, in setting the preliminary assembly in the accommodating section of the casing 10, the heat sink 7, the IC package 16 and the cushion cover 18 never come off. That is, the ignition device of the invention can be assembled with high efficiency.

Figure 2:
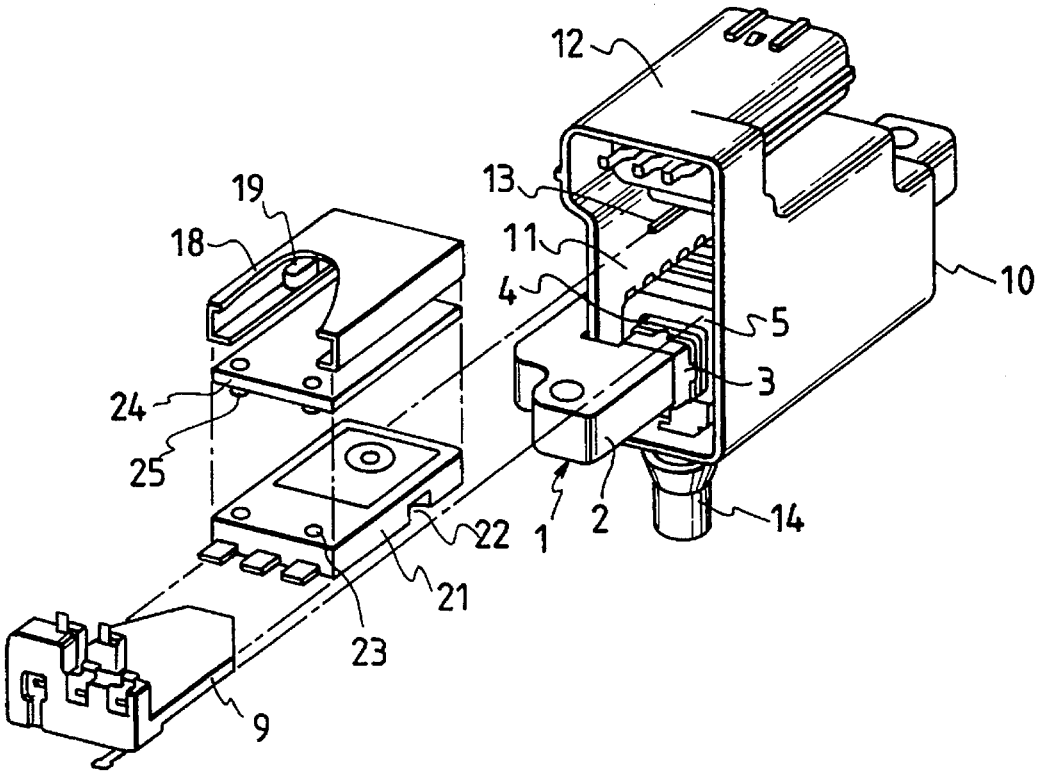
FIG. 2 is a broken perspective view showing an internal combustion engine ignition device according to the third embodiment of the present invention.

FIG. 2 is a broken perspective view showing an internal combustion engine ignition device according to the third embodiment of the present invention.

In FIG. 2, reference numeral 21 designates an IC package including a power switch made up of a current limit circuit or the like which is covered with resin; 22, a first recess formed in the IC package 21; and 23, second recesses formed in the IC package 21.

Further in FIG. 2, reference numeral 24 designates a heat sink adapted to effectively radiate heat from the IC package 21; and 25, protrusions formed on the heat sink 24 to engage with the second recesses 23.

In the third embodiment thus organized, a preliminary assembly is also formed; however, the method of forming the preliminary assembly is different from that in the first embodiment. That is, the protrusions 25 of the heat sink 24 are engaged with the second recesses 23 of the IC package 21, and thereafter the IC package 21 and the heat sink 24 are covered with the cushion cover 18 with the protrusion 19 of the cushion cover 18 engaged with the first recess 22 of the IC package 21.

As was described above, in the third embodiment, the IC package 21 has the second recesses 23, and the heat sink 24 has the protrusions 25 which are engaged with the second recesses 25. Hence, the IC package, the heat sink, and the cushion cover can be positioned with ease, and combined positively. Therefore, the preliminary assembly can be formed with high efficiency. In addition, in setting the preliminary assembly in the accommodating section of the casing, the heat sink, the IC package and the cushion cover will never come off. That is, the ignition device of the invention can be assembled with high efficiency.

Figure 5:
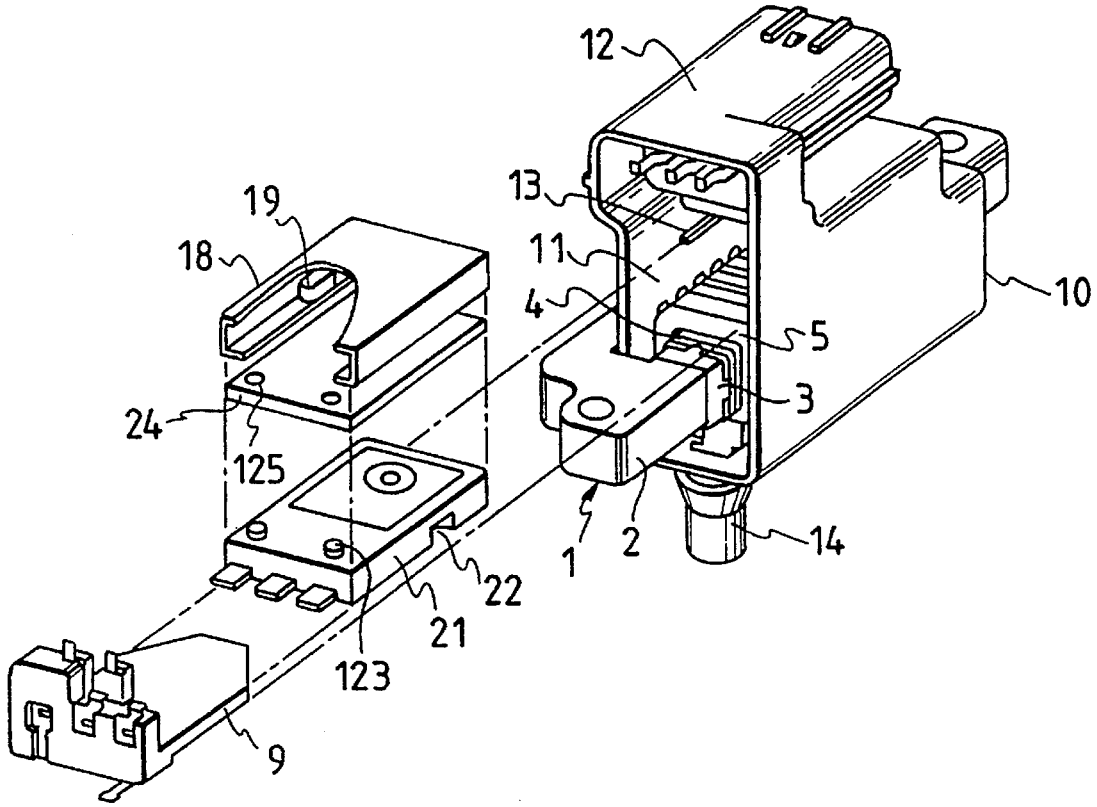
FIG. 5 is a broken perspective view showing another internal combustion engine ignition device according to the third embodiment of the present invention.

On the other hand, in the third embodiment, the IC package 21 may have second protrusions 123 rather than second recesses, and the heat sink 24 may have second recesses 125 rather than second protrusions. This constitution, which is shown in FIG. 5, has the same effect.

Figure 3:
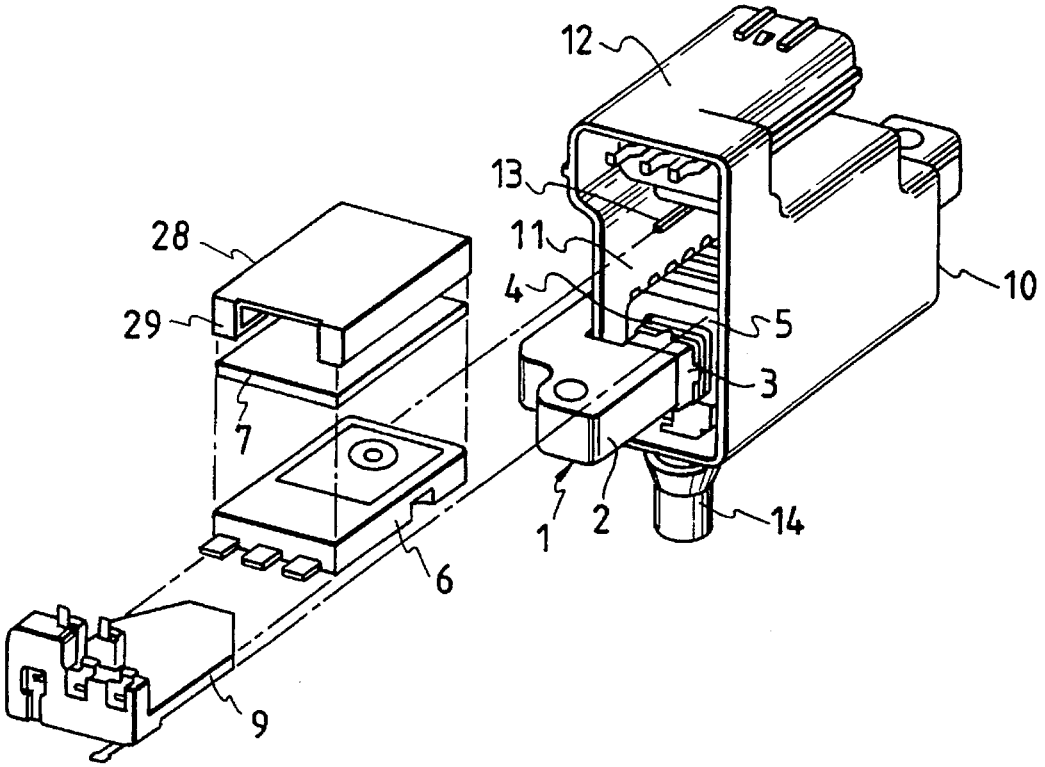
FIG. 3 is a broken perspective view showing an internal combustion engine ignition device according to the fourth embodiment of the present invention.

FIG. 3 is a broken perspective view showing an internal combustion engine ignition device according to the fourth embodiment of the invention. In FIG. 3, reference numeral 28 designates a cushion cover; and 29, a wall for preventing components from coming off.

In the fourth embodiment, the cushion cover 28 has the wall 29 in such a manner that it embraces the IC package 6 and the heat sink 7. Hence, in setting the preliminary assembly in the accommodating section of the casing, the heat sink, the IC package and the cushion cover will never come off. That is, the ignition device of the invention can be assembled with high efficiency.

In the internal combustion engine ignition device according to the first embodiment, the preliminary assembly has the cushion cover for absorbing the thermal stress between the preliminary assembly and the insulating resin. Therefore, the ignition device is high in durability under severe environmental condition.

In the ignition device according to the second embodiment, the control unit has the first recess, while the cushion cover has the protrusion which is engaged with the first recess of the control unit. Hence, in setting the preliminary assembly in the accommodating section of the casing, the heat sink, the control unit and the cushion cover will never come off. That is, the ignition device can be assembled with high efficiency.

In the ignition device according to the third embodiment, the control unit has the second recess, and the heat sink has the protrusion which is engaged with the second recess of the control unit. Hence, the components are positioned with ease, and combined positively. Therefore, the preliminary assembly can be formed with high efficiency. In addition, in setting the preliminary assembly in the accommodating section of the casing, the heat sink, the IC package and the cushion cover will never come off. That is, the ignition device of the invention can be assembled with high efficiency.

In the ignition device according to the fourth embodiment, the cushion cover includes the wall for preventing components from coming off. Therefore, the ignition device, similarly as in the ignition devices described above, can be assembled with high efficiency.

What is claimed is:

1. An internal combustion engine ignition device comprising:

an ignition coil;

a preliminary assembly; and a casing for accommodating and covering said ignition coil and said preliminary assembly with an insulating resin;

said preliminary assembly comprising:

a heat sink;

a control unit comprising a control circuit for controlling a flow of primary current in said ignition coil; and a cushion cover for covering said heat sink and said control unit, and absorbing thermal stress between said preliminary assembly and the insulating resin, wherein at least one first protrusion is formed on said cushion cover, and at least one first recess is formed on said control unit for engaging with said first protrusion of said cushion cover.

2. An internal combustion engine ignition device according to claim 1, wherein at least one second protrusion is formed on said heat sink, and at least one second recess is formed on said control unit for engaging with said second protrusion of said heat sink.

3. An internal combustion engine ignition device according to claim 1, wherein at least one second recess is formed on said heat sink, and at least one second protrusion is formed on said control unit for engaging with said second recess of said heat sink.

4. An internal combustion engine ignition device as recited in claim 1, wherein said cushion cover comprises a wall for preventing said heat sink and said control unit from coming off.

* * * * *